US010663230B2

(12) United States Patent
Dahl

(10) Patent No.: US 10,663,230 B2
(45) Date of Patent: May 26, 2020

(54) TRUE COUNTERCURRENT HEAT EXCHANGER WITH SEALING ARRANGEMENT

(71) Applicant: Haldor Topsøe A/S, Kgs. Lyngby (DK)

(72) Inventor: Per Juul Dahl, Vedbæk (DK)

(73) Assignee: Haldor Topsoe A/S, Lyngby (DK)

( * ) Notice: Subject to any disclaimer, the term of this patent is extended or adjusted under 35 U.S.C. 154(b) by 33 days.

(21) Appl. No.: 15/514,961

(22) PCT Filed: Oct. 5, 2015

(86) PCT No.: PCT/EP2015/072914
§ 371 (c)(1),
(2) Date: Mar. 28, 2017

(87) PCT Pub. No.: WO2016/055406
PCT Pub. Date: Apr. 14, 2016

(65) Prior Publication Data

US 2018/0238628 A1 Aug. 23, 2018

(30) Foreign Application Priority Data

Oct. 8, 2014 (EP) ..... 14188114

(51) Int. Cl.

| | |
|---|---|
| ***F28D 7/16*** | (2006.01) |
| ***F28F 9/22*** | (2006.01) |
| ***F28F 9/26*** | (2006.01) |
| ***F28D 7/06*** | (2006.01) |

(52) U.S. Cl.
CPC ..... *F28D 7/1607* (2013.01); *F28D 7/06* (2013.01); *F28D 7/16* (2013.01); *F28F 9/22* (2013.01); *F28F 9/26* (2013.01); *F28F 2009/224* (2013.01); *F28F 2230/00* (2013.01)

(58) Field of Classification Search
CPC .. F28D 7/06; F28D 7/16; F28D 7/1607; F28F 2009/222; F28F 2009/224; F28F 9/22
See application file for complete search history.

(56) References Cited

U.S. PATENT DOCUMENTS

| | | | | |
|---|---|---|---|---|
| 1,955,006 | A | 4/1934 | Mateer et al. | |
| 2,523,174 | A * | 9/1950 | Worn | F28D 7/06 165/110 |
| 2,550,725 | A | 5/1951 | Schultz | |
| 2,900,173 | A | 8/1959 | Pickford | |
| 3,958,630 | A | 5/1976 | Smith | |
| 4,142,578 | A | 3/1979 | Smith | |
| 4,778,005 | A | 10/1988 | Smith | |
| 2007/0039824 | A1 * | 2/2007 | Salbilla | A61L 2/02 204/555 |

FOREIGN PATENT DOCUMENTS

| | | | |
|---|---|---|---|
| DE | 36 43 303 A1 | | 6/1988 |
| DE | 19650086 | * | 3/1998 |
| JP | 54132006 | * | 10/1979 |
| JP | 62166289 A | * | 7/1987 |
| WO | WO 2008/071725 A1 | | 6/2008 |
| WO | WO 2008/145652 A2 | | 12/2008 |

* cited by examiner

*Primary Examiner* — Eric S Ruppert
(74) *Attorney, Agent, or Firm* — Blank Rome LLP

(57) ABSTRACT

A heat exchanger has a pass baffle which is formed as an enclosure with two openings, one opening for connection to a shell-side fluid opening and one opening for passing heat exchanger tubes.

11 Claims, 2 Drawing Sheets

TRUE COUNTERCURRENT HEAT EXCHANGER WITH SEALING ARRANGEMENT

BACKGROUND OF THE INVENTION

This invention relates to shell and tube heat exchangers and similar equipment and is particularly concerned with improving of the arrangement for sealing a pass baffle in a manner which prevents fluid leaks which have the effect of bypassing within the heat exchanger.

Shell and tube heat exchangers are widely used for the indirect transfer of heat from one fluid to another. Typically, such an exchanger consists of an external shell having inlet and outlet ports for circulation of the shell-side fluid. A bundle of tubes is positioned within the shell and provided with transverse baffles or cross baffles for directing the shell-side fluid back and forth across the tubes. The tubes are supported by one or more tube sheets, one of which is normally stationary, and if another is used, it may be of the floating type to accommodate changes in tube length due to thermal expansion. The tube bundle and shell may be arranged so that the tube-side fluid makes a single pass through the shell or instead makes two or more passes. In a single pass exchanger, the tube-side fluid is introduced into a head at one end of the shell and withdrawn from a second head at the other end. In a multiple pass unit, the exchanger will generally be provided with an internal head containing one or more baffles so that the tube-side fluid can be introduced into one portion of the head and withdrawn from the other portion. An internal head within which the tube-side fluid flows from one set of tubes into another will generally be located at the other end of the tube bundle. A further type heat exchanger has an integral cover head which comprises two parts where the tube-side fluid is introduced in one part and extracted in the other part. The tube bundle comprises U-tubes which are arranged in a two pass shell.

Those experienced in the art will readily appreciate that a wide variety of different combinations of shell and tube arrangements may be employed as the process requirements demand. However, in all such arrangements, it is generally desirable to have efficient and effective fluid seals between the shell and any pass baffles to prevent bypassing of inlet fluid around the pass baffle to the shell outlet connection, thus losing efficiency of the heat exchanger. Reference may be made to applicant's two prior patents, U.S. Pat. Nos. 3,958,630 and 4,142,578, for background in the heat-exchange field, and their disclosure is hereby incorporated herein by reference.

The present invention is particularly applicable to process heat exchangers with removable tube bundles and multiple shell-side passes such as more completely described in The Tubular Exchanger Manufacturer's Association (TEMA), Type BFU, such industry standards being herein incorporated by reference. While this general type industry standard heat exchanger offers very desirable process flexibility, it has not always proved effective in service because the pass baffle/shell seals are ineffective and much of the shell-side fluid can bypass the tube bundle, particularly after maintenance has been done to the tube bundle and the pass baffle seals damaged. In heat exchangers of this type, the higher pressure is always in the inlet of the shell and the lower pressure is at the outlet of the shell. The differential pressure across the pass baffle aids in the sealing of the pass baffle to the shell wall, but what has been experienced is that the commercially available seal designs, while initially being effective (having been assembled by the manufacturer with great care), are easily damaged in the field during maintenance operation on the tube bundle. Typically, such maintenance involves cleaning of scale from the tubes requiring that the bundle must be removed from the shell, lifted onto pallets, rolled over for cleaning, lifted again, and reinserted into the shell. At best, bundles are lifted with wide straps that pass around the lower periphery of each bundle and very readily damage the existing seals of such bundles installed by the manufacturer since they normally protrude beyond the periphery of the bundle and therefore are in contact with the straps during any lifting or rolling operations.

The problem of seals between the internal parts of heat exchangers has been addressed by numerous prior art patents; for example, U.S. Pat. No. 2,550,725 shows a heat exchanger employing elongated spring steel strips for locating and securing the pass baffle relative to the exchanger shell. Another U.S. Pat. No. 2,900,173 also contemplates an arcuate or curved seal strip located in a notch in the head wall to seal against a baffle plate. Other patents such as U.S. Pat. No. 1,955,006 shows an arrangement for injecting a lubricant into the gap between a baffle plate and the shell wall of a heat exchanger.

While all of these references recognize the desirability of sealing within heat exchangers, none of them solves the problem according to the present novel and advantageous design.

SUMMARY OF THE INVENTION

Accordingly, with the present invention, an insert is provided in the shell part of the heat exchanger which omits the necessity of a sealing along the inside shell wall as described in the state of the art.

Accordingly, it is an object of this invention to provide an improved heat exchanger design which is not subject to damage during normal maintenance procedures.

A further object of the invention is to provide a heat exchanger design which reduces the possible leak between the two shell side passes to the connection between the insert and a shell side nozzle.

Yet a further object of the invention is to provide a connection between the insert and the shell side of the heat exchanger which can be easily serviced. A further object of the invention is to provide a heat exchanger which presents a safe continuous true counter current service for a TEMA type BFU (Bonnet integral cover, two pass shell with longitudinal baffle, U-tube bundle).

These and other objects and advantages of the invention will become apparent and the invention will be fully understood from the following features, description and drawings.

FEATURES OF THE INVENTION

1. A shell and tube heat exchanger comprising a tube bundle comprising a first and a second end secured at the first end to a tube sheet, an outer shell surrounding said tube bundle comprising at least two shell fluid connections: a shell inlet and a shell outlet, a head member affixed to said shell adjacent said tube sheet having a tube side inlet and a tube side outlet, said tube bundle comprising a longitudinally extending pass baffle comprising a first end and a second end for dividing shell side fluid into two passes between said shell inlet and shell outlet, wherein said baffle forms an enclosure comprising two openings, a first opening adapted to connection with a shell fluid connection and a second opening in the second end of the baffle for passing of the tube bundle.

2. A shell and tube heat exchanger according to feature 1, wherein said first opening is adapted to connection with the shell inlet.

3. A shell and tube heat exchanger according to feature 1, wherein said first opening is adapted to connection with the shell outlet.

4. A shell and tube heat exchanger according to any of the preceding features, wherein said first opening is detachable connected to the shell inlet or shell outlet and is adapted to be attached or detached from the outside of the outer shell through said shell inlet or shell outlet 5. A shell and tube heat exchanger according to any of the preceding features, wherein said first opening is adapted to fluid tight connection with a shell fluid connection.

6. A shell and tube heat exchanger according to feature 5, wherein said fluid tight connection is a spool piece.

7. A shell and tube heat exchanger according to any of the preceding features, wherein said baffle is fixed to said tube sheet at its first end.

8. A shell and tube heat exchanger according to feature 7, wherein the baffle is fixed to the tube sheet by means of welding.

9. A shell and tube heat exchanger according to feature 7, wherein the baffle is detachably fixed to the tube sheet.

10. A shell and tube heat exchanger according to any of the preceding features, wherein the baffle is fluid tight fixed to the tube sheet.

11. A shell and tube heat exchanger according to any of the preceding features, wherein said baffle is at least partly insulated to provide thermal insulation between the two passes of the shell side fluid.

12. A shell and tube heat exchanger according to any of the preceding features, wherein said baffle has one flat side and one half circle side, forming a half moon cross sectional shape.

13. A shell and tube heat exchanger according to any of the preceding features, wherein said tube bundle comprises a plurality of U-tubes.

14. A shell and tube heat exchanger according to feature 13, wherein said baffle is extending from the first end of the U-tubes to the inside side of the bends of the U-tubes.

It will be understood that the drawings illustrate merely a representative embodiment of the invention and that other embodiments are contemplated within the scope of the claims.

DETAILED DESCRIPTION OF THE INVENTION

Figure 1:
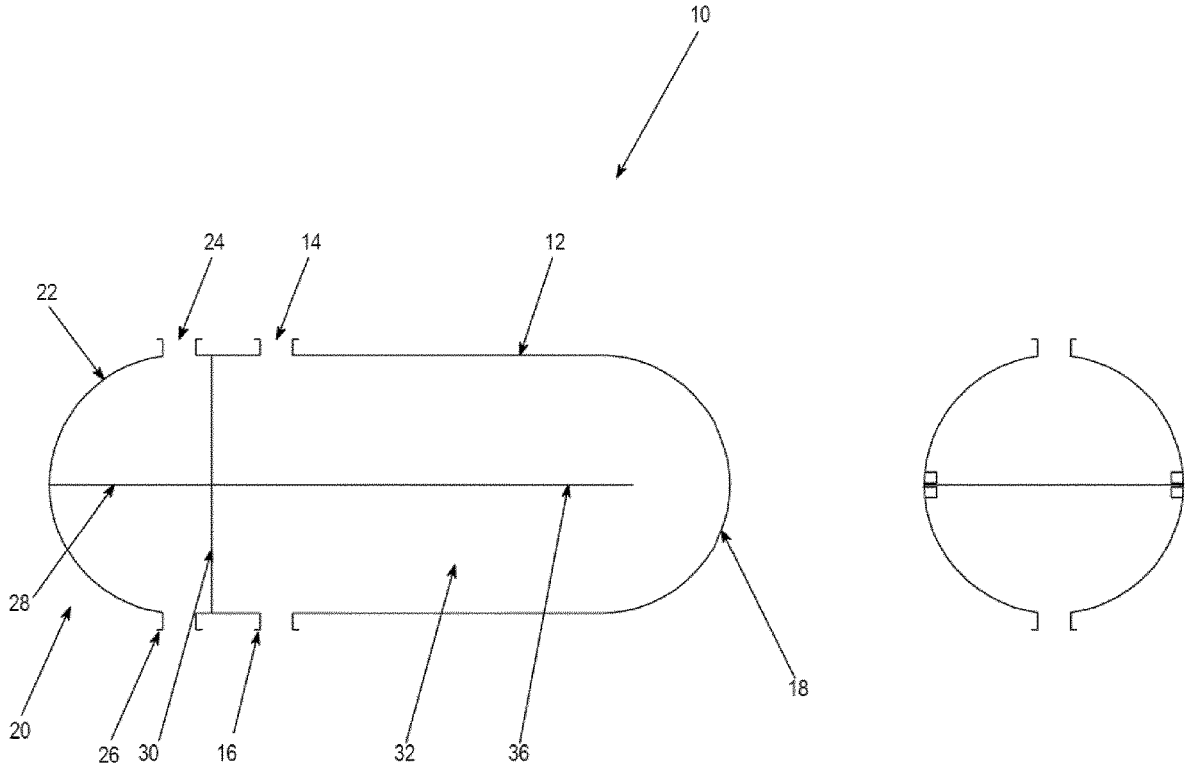
FIG. 1 is a horizontal cross-section of a heat exchanger according to the state of the art.

The heat exchanger shown in FIG. 1 is a two pass shell and tube unit according to the state of the art in which the tube-side fluid makes two passes through the unit and the shell-side fluid also makes two passes. The exchanger 10 includes an elongated, generally cylindrical outer shell 12 having a shell-side fluid inlet 14 and a shell-side fluid outlet 16. One end of the shell 12 is enclosed by a head 18 while the opposite end is capped with a heat exchanger head generally indicated at 20. The head 20 includes a removable cover 22, an internal stop baffle or pass partition 28, as well as a tube-side inlet 26 and a tube-side outlet 24.

The tube bundle in the exchanger of FIG. 1 comprises a plurality of "U" shaped tubes 32 attached at their inlet and outlet ends to a tube sheet 30. The tube sheet 30 is securely clamped about its outer periphery between the flanges on the shell 12 and the exchanger head 20. Extending horizontally between the upper and lower passes of each "U" tube 32 is a horizontal pass baffle indicated at 36. The pass baffle 36 is securely welded at one end to the tube sheet 30. When the head 20 of the exchanger is removed from the tube sheet 30 and the tube sheet 30 and its associated tube bundle is slidably removed from the shell 12, the pass baffle 36 may be withdrawn from the shell 12. Experience shows that there is a potential risk of leak from the inlet side of the shell to the outlet side of the shell, resulting in a part of the shell side fluid will pass the edges of the baffle 36, thus not flowing through the entire length of the shell in a true counter current relative to the tube side fluid.

Figure 2:
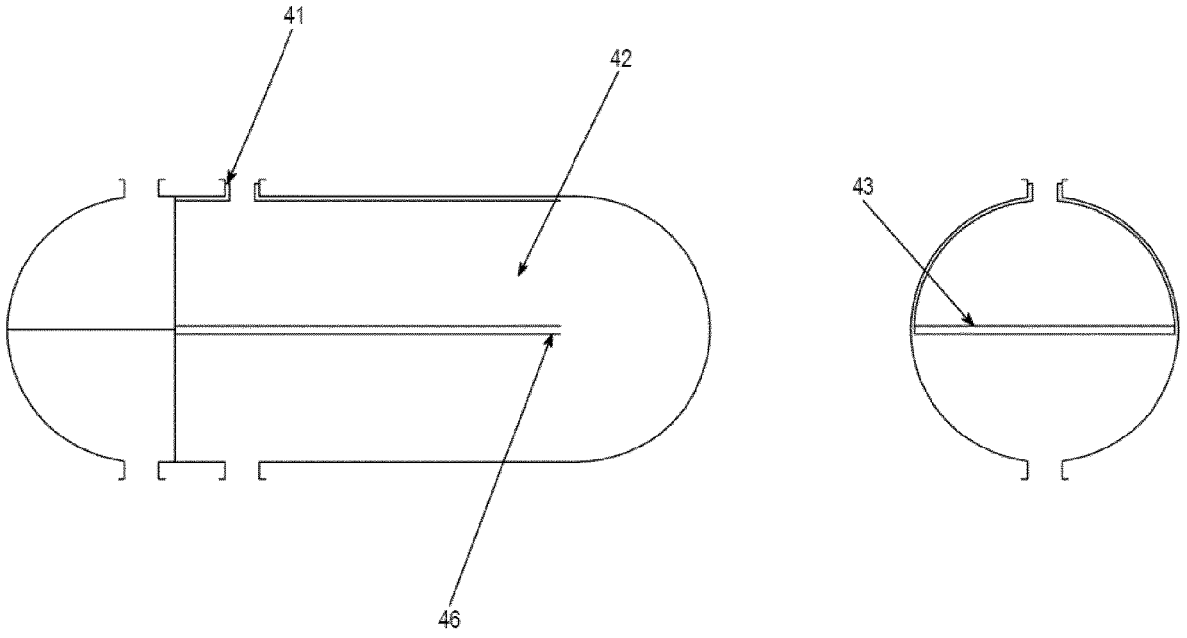
FIG. 2 is a horizontal cross-section of a heat exchanger in accordance with the invention.

In an embodiment of the invention according to FIG. 2, the pass baffle 46 is formed as an enclosure with only two openings, one opening 41 adapted to connection with a shell fluid connection, and a second opening 42 in the second end of the pass baffle 46 for passing of the tube bundle 32. There is no sealing between the shell inner side and the pass baffle, and thus no risk of any leak in such a sealing due to for instance damage or incorrect installation. In FIG. 2, the first opening of the pass baffle is connected to the shell-side fluid inlet 14, but it may be understood that the function of the heat exchanger can also be ensured if the first opening of the pass baffle is connected to the shell-side fluid outlet 16. The pass baffle may be in the cross-sectional form of a half moon, with a lower side which is substantially planar and an upper side which has a half circle cross sectional shape. To increase the thermal efficiency of the heat exchanger, at least one side of the pass baffle may be thermally insulated. The first opening of the pass baffle can be fluid tight connected to a shell fluid connection. Easy access to the shell fluid connection can be made by installing a spool piece as known in the art in connection with the shell nozzle.

Attachment or detachment of the first opening of the pass baffle may be done from the outside of the shell, through the shell-side fluid inlet or outlet which the first opening of the pass baffle is connected or is to be connected to. When shell-side fluid enters the shell, it is according to the invention forced to pass through the enclosure formed by the pass baffle when performing one of the passes through the shell and the only source of leak is the connection of the first opening of the pass baffle to the shell-side fluid inlet or outlet and not as previously known in the art, the entire length of the pass baffle.

While a specific embodiment of the invention has been shown and described in detail to illustrate the application of the invention principals, it will be understood that the invention may be embodied otherwise without departing from said principals.

The invention claimed is:

1. A shell and tube heat exchanger comprising:

a tube bundle comprising a first end and a second end, said tube bundle being secured at the first end to a tube sheet, an outer shell on a shell side of the tube sheet, surrounding said tube bundle and comprising at least two shell fluid connections: a shell fluid inlet and a shell fluid outlet, the shell fluid inlet and outlet each comprising an opening in the shell, a head member affixed to said shell and disposed on a side of said tube sheet opposite the shell side, the head member having a tube side inlet and a tube side outlet, a longitudinally extending pass baffle disposed within said outer shell and comprising a first end and a second end for dividing shell side fluid into two passes between said shell fluid inlet and shell fluid outlet, wherein said baffle forms an enclosure within the shell having only two openings:

a first opening, at a first end of said baffle, sealingly and detachably connected to said shell fluid inlet with a fluid tight, detachable connection disposed in the opening in the outer shell, the first opening of said baffle extending within said shell fluid inlet and being adapted to be sealingly attached to or detached from said shell fluid inlet from the outside of the outer shell, such that, when shell fluid enters the heat exchanger through the shell fluid inlet, all of the shell fluid is forced to pass through the first opening of the baffle and directly into the enclosure of the baffle within the shell, with no shell fluid entering the heat exchanger flowing between the enclosure of the baffle and the shell, and a second opening in the second end of the baffle for passing of the tube bundle.

2. A shell and tube heat exchanger according to claim 1, wherein said first opening is sealingly and detachably connected to the shell fluid inlet.

3. A shell and tube heat exchanger according to claim 1, wherein said first opening is sealingly and detachably connected to the shell fluid outlet.

4. A shell and tube heat exchanger according to claim 1, wherein said baffle is fixed to said tube sheet at its first end.

5. A shell and tube heat exchanger according to claim 4, wherein the baffle is fixed to the tube sheet by means of welding.

6. A shell and tube heat exchanger according to claim 4, wherein the baffle is detachably fixed to the tube sheet.

7. A shell and tube heat exchanger according to claim 1, wherein the baffle is fluid tight fixed to the tube sheet.

8. A shell and tube heat exchanger according to claim 1, wherein said baffle is at least partly insulated to provide thermal insulation between the two passes of the shell side fluid.

9. A shell and tube heat exchanger according to claim 1, wherein said baffle has one flat side and one half circle side, forming a half moon cross sectional shape.

10. A shell and tube heat exchanger according to claim 1, wherein said tube bundle comprises a plurality of U-tubes.

11. A shell and tube heat exchanger according to claim 10, wherein said baffle extends from a first end of the U-tubes at the tube sheet to a location at which the U-tubes begin to bend.

* * * * *